US008298036B2

(12) United States Patent
Yu et al.

(10) Patent No.: US 8,298,036 B2
(45) Date of Patent: Oct. 30, 2012

(54) DYNAMO POWERED AMUSEMENT DEVICE

(75) Inventors: Sun Yu, Berkley, MI (US); David Perrin, Rochester, MI (US)

(73) Assignee: Zen Design Group, Ltd., Berkley, MI (US)

( * ) Notice: Subject to any disclaimer, the term of this patent is extended or adjusted under 35 U.S.C. 154(b) by 1396 days.

(21) Appl. No.: 11/462,414

(22) Filed: Aug. 4, 2006

(65) Prior Publication Data

US 2008/0125006 A1 May 29, 2008

(51) Int. Cl.
*A63H 30/00* (2006.01)

(52) U.S. Cl. ..... 446/175; 446/297; 446/303; 446/484

(58) Field of Classification Search ..... 446/140, 446/246, 268, 303, 310
See application file for complete search history.

(56) References Cited

U.S. PATENT DOCUMENTS

| | | | | |
|---|---|---|---|---|
| 4,214,198 | A | 7/1980 | Schneider | |
| 4,354,448 | A | 10/1982 | Lin et al. | |
| 4,890,528 | A | 1/1990 | Kamijima | |
| 5,020,725 | A | 6/1991 | Waldrum | |
| 5,455,485 | A | 10/1995 | Kutter et al. | |
| 6,546,286 | B2 | 4/2003 | Olson | |
| 6,588,918 | B1 | 7/2003 | Millar | |
| 6,943,459 | B2 | 9/2005 | Hartman et al. | |
| 6,995,542 | B2 | 2/2006 | Yu et al. | |
| 7,030,592 | B2 | 4/2006 | Yu | |
| 7,173,348 | B2 | 2/2007 | Voda et al. | |
| 7,239,237 | B2 * | 7/2007 | Hess | 340/539.1 |
| 2002/0098770 | A1 * | 7/2002 | Mesch | 446/310 |
| 2004/0185747 | A1 * | 9/2004 | Chiu | 446/444 |
| 2005/0153661 | A1 * | 7/2005 | Beck | 455/73 |
| 2006/0154690 | A1 | 7/2006 | Hess | |
| 2007/0025102 | A1 | 2/2007 | Yu | |
| 2007/0080814 | A1 | 4/2007 | Ellsworth et al. | |
| 2007/0105610 | A1 | 5/2007 | Anderson | |

FOREIGN PATENT DOCUMENTS

| | | |
|---|---|---|
| DE | 3502394 | 7/1986 |
| DE | 19934861 | 6/2000 |
| EP | 0140288 | 5/1985 |
| EP | 0666633 B1 | 8/1995 |
| EP | 0676612 A1 | 10/1995 |
| EP | 1034823 | 9/2000 |
| EP | 1520773 | 4/2005 |
| GB | 477601 | 12/1937 |
| GB | 925825 | 5/1963 |

(Continued)

*Primary Examiner* — Dmitry Suhol
*Assistant Examiner* — Alex F. R. P. Rada, II
(74) *Attorney, Agent, or Firm* — Patent Procurement Services

(57) ABSTRACT

A dynamo powered amusement device is provided that has multiple amusement functions integrated into a housing. The amusement functions include two or more of a movement, a light emitting diode illumination, an auditory output and a video presentation. The electrical power source for the amusement functions is a manually powered dynamo. The direct current generated by a dynamo is provided to a printed circuit board in electrical communication with the amusement functions so as to provide power directly from the manually powered dynamo or, if a chargeable battery is present, to supply power from the chargeable battery. The amusement device provides enhanced performance relative to mechanical amusement devices while avoiding costs and environment problems associated with disposable battery containing amusement devices.

31 Claims, 4 Drawing Sheets

FOREIGN PATENT DOCUMENTS

| | | |
|---|---|---|
| GB | 2124441 | 2/1984 |
| GB | 2299765 | 10/1996 |
| GB | 2345596 | 7/2000 |
| GB | 2355868 | 5/2001 |
| GB | 2388053 | 11/2003 |
| JP | 1470995 | 4/1977 |
| JP | 1490105 | 10/1977 |
| JP | 55141954 | 11/1980 |
| JP | 2000157750 | 6/2000 |
| WO | WO-9534117 | 12/1995 |
| WO | WO-03046853 | 6/2003 |
| WO | WO-2008119099 | 10/2008 |

* cited by examiner 100
115
114
112
116

102
104
120
100

28
106
108
110
112
114
117

120
106

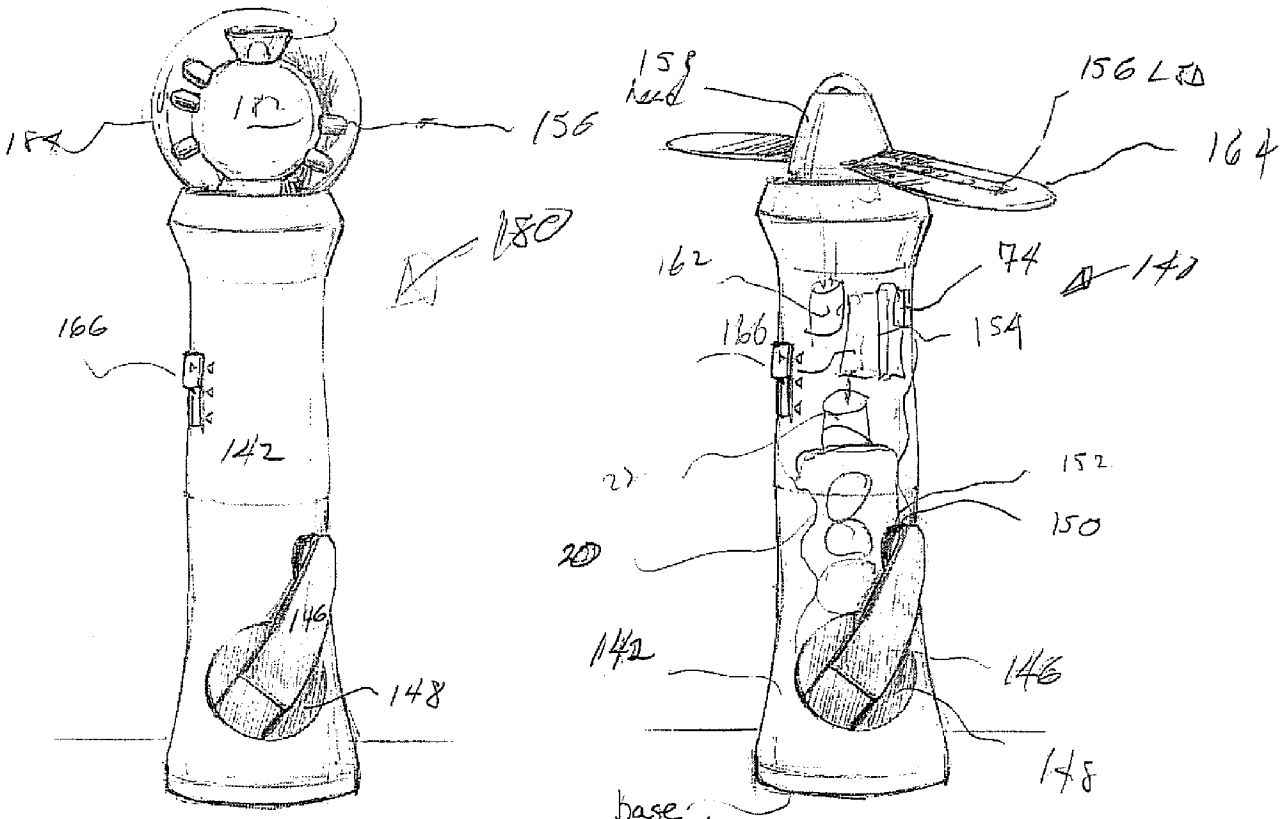
Fig. 9
Fig. 8
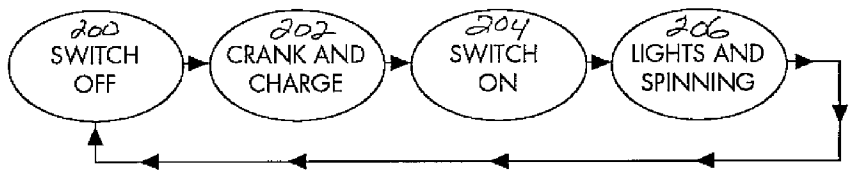
Fig. 10

DYNAMO POWERED AMUSEMENT DEVICE

FIELD OF THE INVENTION

The present invention in general relates to a dynamo containing amusement device and in particular to an amusement device providing multiple electrically powered amusement functions with power derived from dynamo operation.

BACKGROUND OF THE INVENTION

Mechanically powered amusement devices have traditionally relied upon springs and windings to generate movement or sound. Representative of these early amusement devices are music boxes and penny banks. Mechanical mechanisms suffer from a number of limitations including metal fatigue, complex construction, and imprecise movements. As a result, components such as a spring-loaded button provide variable mechanical resistance throughout the travel during depression, and a music box has a characteristic "tinny" sound to the auditory program.

With the advent of miniature electrical motors and speaker components, battery powered amusement devices largely supplanted mechanical movements. Typically, an electrically powered amusement device offers longer usage between reenergizing, wider material choices, and extended movement longevity. The power source for operating electrically powered amusement devices has largely been disposable alkaline batteries. Reliance on disposable battery power creates inconvenience and cost associated with stocking replacement batteries, as well as creating an ecologically noxious waste stream.

An alternative to the use of alkaline batteries is rechargeable batteries of various chemistries. A rechargeable battery upon being discharged is removed from the amusement device and placed into an electrically powered charger typically coupled to line power or a vehicle electrical system as the power origin. Unfortunately, battery recharge to again power an amusement device requires downtime during which the amusement device cannot be used and often involves adult interaction to remove a battery and place the same into a charging device. Additionally, since an extrinsic electrical source is required to charge the battery, ongoing constraints on usage environment for the amusement device and costs remain.

Thus, there exists a need for an electrically powered amusement device rechargeable by a child absent adult intervention. A further need exists for a dynamo powered rechargeable amusement device alternatively operative between direct dynamo output or from a battery charged by the dynamo.

SUMMARY OF THE INVENTION

A dynamo powered amusement device is provided that has multiple amusement functions integrated into a housing. The amusement functions include two or more of a movement, a light emitting diode illumination, an auditory output and a video presentation. The electrical power source for the amusement functions is a manually powered dynamo. The direct current generated by a dynamo is provided to a printed circuit board in electrical communication with the amusement functions so as to provide power directly from the manually powered dynamo or, if a chargeable battery is present, to supply power from the chargeable battery. The amusement device provides enhanced performance relative to mechanical amusement devices while avoiding costs and environment problems associated with disposable battery containing amusement devices.

BRIEF DESCRIPTION OF THE DRAWINGS

The present invention is further detailed with respect to the following exemplary depictions which are not intended to be a limitation upon the practice of the present invention.

FIG. 8 is a partial cutaway view of a fan torch embodiment of an inventive dynamo powered amusement device;

FIG. 9 is a partial cutaway view of a spinning charm torch embodiment of an inventive dynamo powered amusement device; and FIG. 10 is a schematic flowchart of exemplary operating procedure for the fan torch embodiment of FIG. 8 or FIG. 9.

DETAILED DESCRIPTION OF THE PREFERRED EMBODIMENTS

The present invention has utility as an amusement device that provides two or more amusement functions such as a movement, a light emitting diode illumination, an auditory output and a video presentation without resort to disposable batteries or the necessity of removing a chargeable battery to effect battery recharge. The present invention performs in this manner through the integration of a manually operated dynamo. As a result, a child user is able to enjoy the amusement device indefinitely without resort to adult supervision to replace or charge a battery. With the inclusion of printed circuit board mounting of operational electronics, superior amusement functions as compared to mechanical amusement functions is achieved. It is appreciated that in several inventive embodiments a battery is optionally not present and instead the amusement device operates directly only through manual operation of a dynamo crank.

Figures 1, 2, 3:
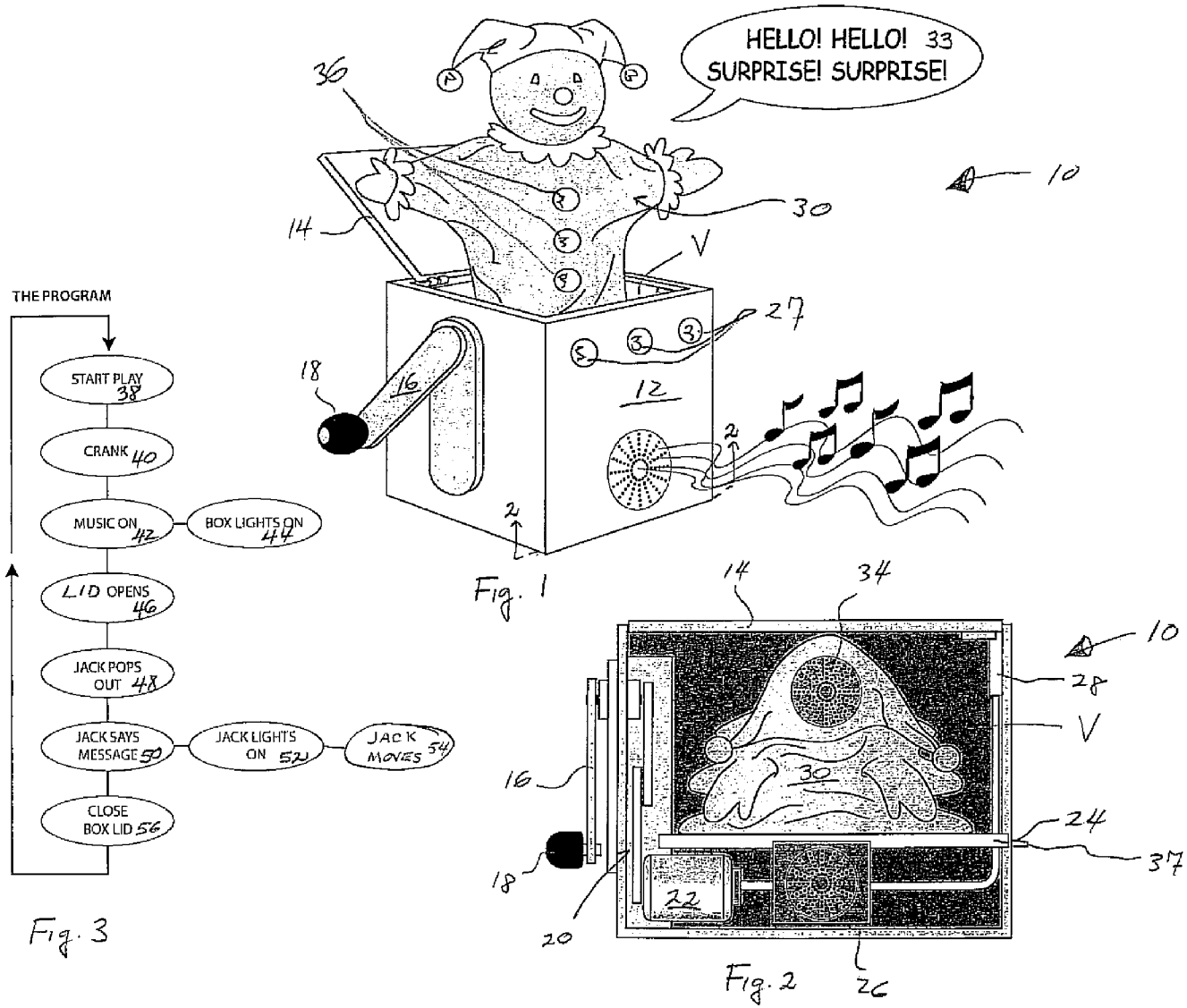
FIG. 1 is a perspective view of a jack-in-the-box embodiment of an inventive dynamo powered amusement device in an open position.
FIG. 2 is a cross-sectional view of the jack-in-the-box embodiment depicted in FIG. 1 in a closed position along line 2-2.
FIG. 3 is a schematic flowchart of an exemplary operating procedure for the jack-in-the-box embodiment of FIG. 1.

Referring now to FIGS. 1 and 2, an inventive dynamo powered amusement device configured as a jack-in-the-box is shown generally at 10. It is appreciated that the attributes of the device 10 are likewise applicable to a music box that also provides a movement, a light emitting diode illumination or video presentation. The device 10 has a housing defining an internal volume V, the volume V being selectively accessible with the opening of a housing lid 14. A hand crank 16 terminating in a rotatable knob 18 is coupled to a dynamo 22 by way of gearing 20. The gearing 20 operates to translate a single rotation of hand crank 16 into multiple input rotations into a dynamo 22 mechanically coupled to the output of the gearing 20. A conventional dynamo-gearing-crank arrangement is depicted in U.S. Pat. No. 6,959,999. The dynamo 22 provides a direct current electrical output to a printed circuit board 24. Operation of the hand crank 16 powers the dynamo 22 that in turn supplies energy input to power a auditory generator 26 located within the housing 12. LEDs 27 located on the housing 12 are also powered in this manner. The auditory generator 26 is operational at least at such time as the hand crank 16 is being operated. Suitable auditory generators to produce an auditory output for use in the present invention illustratively include a speaker, buzzer, piezoelectric vibratory crystal, a bell, music box, clime, and a bellows. The printed circuit board 24 in turn operates a solenoid switch 28 to electrically induce the opening of lid 14 thereby allowing the internal figure to spring forth from the volume V. Figurine 30 is supported around the perimeter of a weal spring constant coil spring (not shown) as is conventional to the art. Optionally, the figurine 30 is in electrical communication with the printed circuit board 24 so as to provide novel functions to the extended figurine such as auditory presentation 33 by way of a figurine auditory generator 34, light emitting diode emission from LEDs 36 decorating the figurine 30, or an electrically powered movement; each of these functions is provided alone or in combination. Unlike a conventional mechanical jack-in-the-box, the amusement device depicted with reference to FIGS. 1 and 2 preferably has a solenoid opening switch 28 that triggers at a random interval so as to create a heightened sense of anticipation. Alternatively, to mimic the function of a conventional mechanical jack-in-the-box, the solenoid 28 is triggered to release after a cumulative time of crank manipulation. Optionally, a switch 37 is provided to vary the mode of solenoid activation.

A schematic operational diagram for the device 10 as depicted in FIGS. 1 and 2 is shown in FIG. 3 as an exemplary operational program. In order to initiate play at step 38, one begins to crank the hand crank 16 at step 40. With rotation of the dynamo 22, prerecorded music or other audio output is provided from auditory generator 26 at step 42 while LEDs 27 within the housing 12 are also activated at step 44. It is appreciated that the temporal interaction between auditory output 42 and light activation 44 during the course of the cranking at step 40 may include any number of various sequences. Preferably, the auditory output continues continually during cranking while the housing lights blink. Thereafter, the solenoid 28 receives a signal from the printed circuit board 24 causing the lid 14 to open at step 46. The compressed FIG. 30 springs from housing volume V at step 48. The jack figurine 30 then preferably plays a prerecorded program 33 through auditory generator 34, if present, or otherwise from auditory generator 26 and/or LED lights 32 associated with the FIG. 30 are illuminated at step 52. Preferably, the FIG. 30 provides both auditory output and LED light emission. As with steps 42 and 44, the temporal relationship between auditory and optional output can take a variety of forms. Optionally, the FIG. 30 also provides a mechanical motion associated with a secondary solenoid within the figure or a motor (not shown) to initiate figure movement at step 54. A typical movement might include releasing a spring associated with a limb so as to simulate a hand wave of the figure. It is appreciated that the user stops manipulating the hand crank subsequent to step 48 and as such electrical power for steps 50-52 is provided through capacitor energy storage within the printed circuit board 24 during cranking. Alternatively, the functions provided at steps 50-54 are provided by continuing to crank after the jack has emerged from the housing at step 48. With the closing of the lid 14 at step 56, the amusement device 10 is ready again for the initiation of play.

Figure 4:
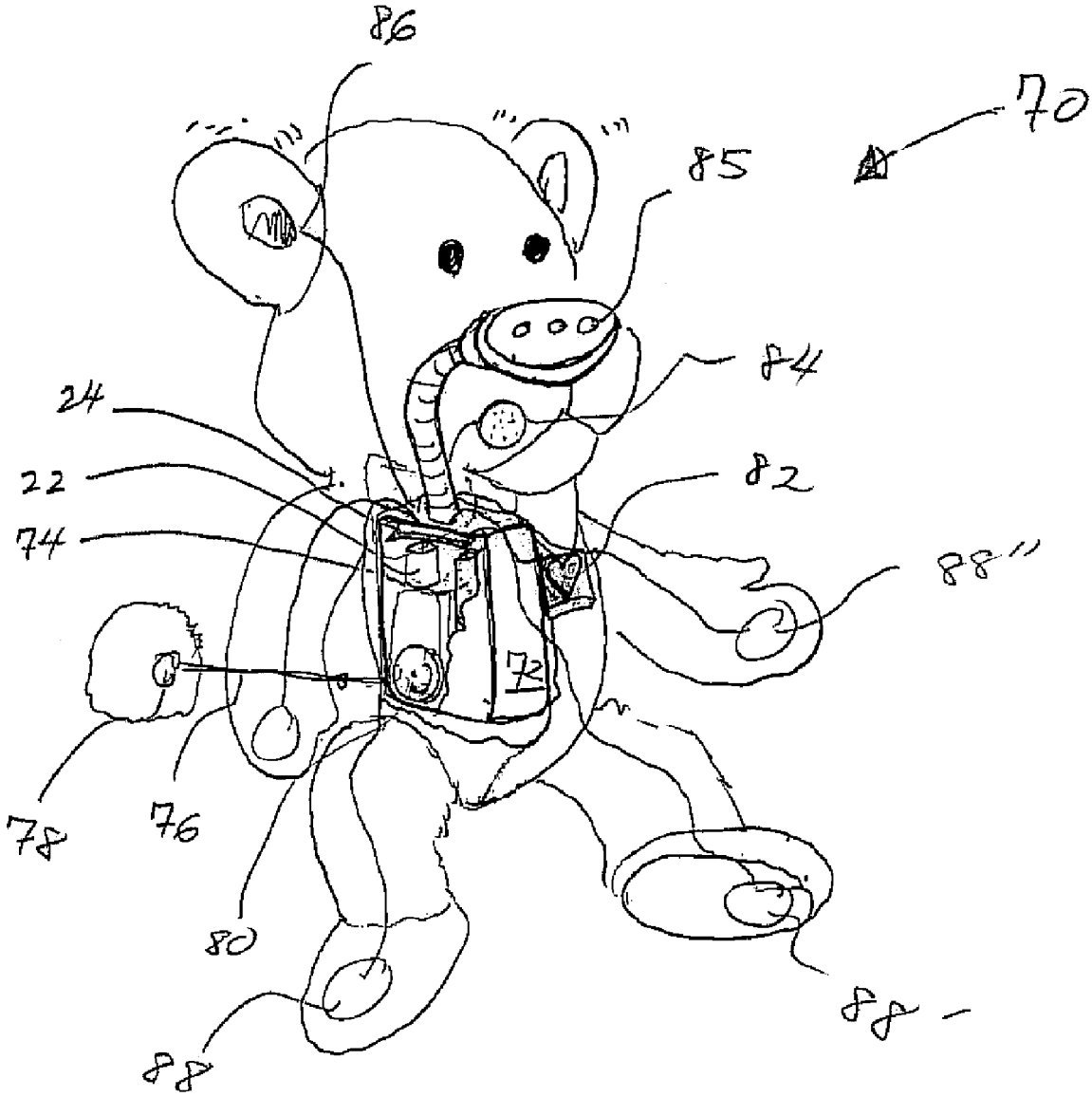
FIG. 4 is a partial cutaway semitransparent view of an animate figurine embodiment of an inventive dynamo powered amusement device.

Referring now to FIG. 4, a partial cutaway semitransparent view of animate figurine embodiment of the present invention is depicted generally at 70 where like numerals correspond to those detailed above with respect to FIGS. 1-3. The figurine 70 as depicted is a plush amusement device configured as a teddy bear. However, it is appreciated that such a figurine is readily constructed to simulate a variety of animal, human, or fanciful creatures and is readily formed from materials illustratively including plush, injection molded thermoplastics, and porcelain. The figurine 70 is in component casing 72. The component casing 72 includes a dynamo 22 providing electrical input to a printed circuit board 24, and optionally a rechargeable battery 74. Rechargeable battery 74 is also in electrical communication with the dynamo and the printed circuit board 24 such that amusement functions driven by printed circuit board 24 are powered either directly from the dynamo 22 or via rechargeable battery 74, that in turn is recharged through operation of the dynamo 22. Extending from component casing 72 is a pull cord 76 terminating in a handle 78. It is appreciated that the size and type of battery 74 is not critical to the present invention. For example, nickel-cadmium, metal hydride, acid, and polymeric batteries are operative herein. Operative battery sizes illustratively include 24 volt, 12 volt, 9 volt, AAA, AA, B, C, and D sized cells. Optionally, the handle 78 is rendered in the form of a figure body portion or accoutrement. The pull string 76 engages a spring-tensioned spool 80 in mechanical communication with the dynamo 22 to induce movement thereof. The figurine 70 in one operational mode commences to provide at least two forms of amusement for a user in the form of LED emission; electrically driven movable jointed appendages such as a jaw, neck, ears or a limb; a auditory generator providing prerecorded music and/or spoken utterances; a microphone recording and a auditory generator playing back the recording; and a video display. While a full complement of amusement functions are depicted on figurine 70, it is appreciated that an inventive device need not be inclusive of all such components. These components depicted in FIG. 4 include a video display 82, a auditory generator 26, a microphone 84, LEDs 85, and a mechanical actuator 86, each of which is in electrical communication with the printed circuit board 24 by way of electrically conductive wires or directly fixtured thereto. At least one switch 88 is optionally provided such that a user elects components that are to be operative to provide an amusement function. By way of example, toddlers are often fearful of a figurine 70 of an animate creature and as such emission from LEDs 85 positioned within the nose of the FIG. 70 is precluded by pressing the left foot switch 88', while for instance 88" activates a prerecorded message.

Figures 5, 6, 7:
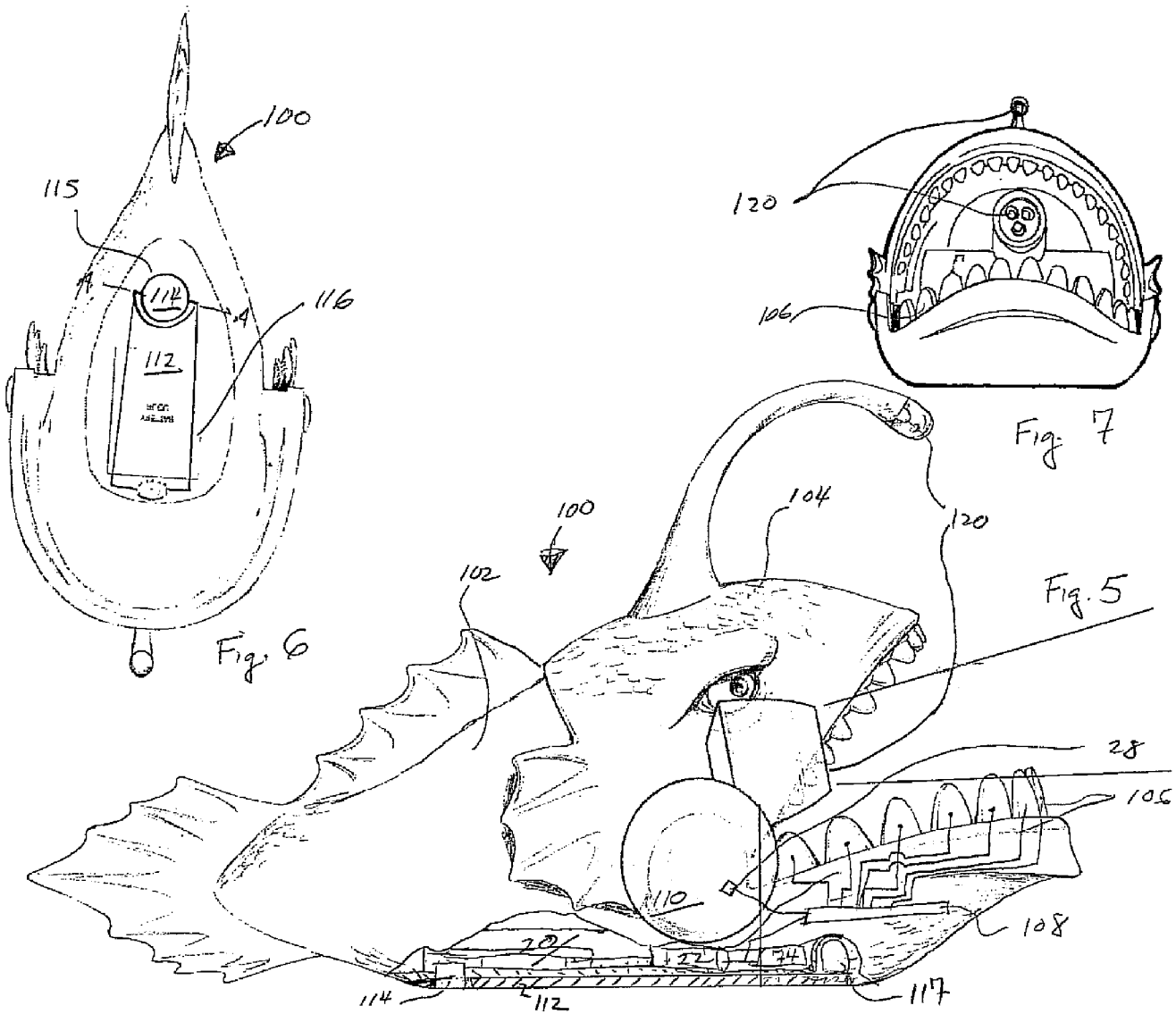
FIG. 5 is a partial cutaway semitransparent view of a chance game embodiment of an inventive dynamo powered amusement device.
FIG. 6 is a bottom view of the chance game embodiment depicted in FIG. 5.
FIG. 7 is a front view of the chance game embodiment depicted in FIG. 5.

Referring now to FIG. 5, a game of chance is depicted generally in partial cross-sectional semitransparent view at 100 where like numerals correspond to those detailed above with respect to those particular elements. The game 100 includes a housing stationary portion 102 having a hingeably attached movable portion 104. The housing portions 102 and 104 in combination are provided in a simulative form of an animal, human, fanciful creature, a cave, or a manmade structure illustratively including a garbage truck and a trap. The housing portions 102 and 104 are each independently formed of an injection moldable thermoplastic, an elastomer or combination subcomponents thereof. A series of electrical switches 106 are exposed upon the hingeable attached movable portion 104 being rotated into an open position. Switches 106 are in electrical communication with a printed circuit board 108 that randomly assigns to one of the multiple switches 106 a circuit connection to a solenoid 28 engaging a spring-loaded hinge 110. Electrical power is provided to the circuit board 108 and ultimately to the solenoid 28 by way of a chargeable battery. The chargeable battery 84 in turn is charged by a dynamo 22. The dynamo 22 generates an electrical output through the rotation of a hand crank 112 rotatable about a spindle 114. Spindle 114 conveys rotational mechanical energy to the dynamo 22 by way of gearing 20. As depicted in FIGS. 5-7, the hand crank 112 is recessed into a basal surface 115 of the stationary housing portion 102. An access door 116 is also optionally provided in the basal surface 115. The hand crank 112 preferably includes a knob 117 that sits within stationary housing portion 102 when not in use. Elevating the handle 112 through an arc of 180 degrees around hinge axis A-A exposes the knob 117 and allows the handle 112 to rotate circumferentially around the spindle 114. In addition to the printed circuit board 108 arbitrarily forming a circuit between one of the switches 106 and the solenoid 28 so as to cause the hingeably attached movable portion 104 to rotate relative to the stationary housing portion 102, the chance game 100 is optionally provided with one or more light emitting diodes 120 or a auditory generator providing a prerecorded audio amusement function (not shown). The LED 120 is in electrical communication with the printed circuit board 108 and derives operational power therefrom.

A chance game as depicted at 100 in FIGS. 5-7 represents a considerable improvement over prior art, nonelectrical forms of such a chance game that operate through mechanical depression of a randomly selected key to induce a hingeable portion to close. Such mechanical versions of this game have a tension associated with the triggering key that can be felt by a game participant prior to triggering so as to avoid that particular key. Additionally, keys adjacent to a triggering key receive a certain bracing based on their position and relative to other nonactive keys so as to afford still another mechanism by which a chance game participant may manipulate the outcome. U.S. Pat. No. 5,193,808 is representative of this prior art supplanted by the present invention.

Referring now to FIG. 8 where like numerals correspond to those detailed above with respect to the previous figures, an inventive amusement device having a rotating lighted portion is depicted generally at 140. The device 140 has a housing 142. Preferably the housing 142 has a planar base 144. The base 144 has dimensions relative to the center of gravity of the device 140 such that the device 140 is operable resting on the base 144. While a variety of conventional materials are well suited for the formation of the housing 142, injection moldable thermoplastic represents a preferred material. A hand crank 146 is mechanically coupled to gearing 20 that feeds the mechanical power to operate a dynamo 22. The hand crank 146 is preferably hingeably connected to a crank spindle 148. More preferably, the crank 146 terminates in a rotatable knob 150. The knob 150 is preferably adapted to insert within a recess 152 within the housing 142. Upon elevating the hand crank 146 through an axis of 180 degrees, the knob 150 is exposed in order to provide power the dynamo 22. The dynamo 22 generates direct current electrical power that is fed to a printed circuit board 154 to either directly power LEDs 156 and rotation of a head portion 158 or alternatively to charge a battery 74 that in turn is used to illuminate LED 156 or the rotation of the head 158 at times when the hand crank 146 is not being operated. An electric motor 162 is operated by way of the printed circuit board 154 to power the rotation of head 158. The head 158 optionally has one or more fan blades 164 so as to provide a measure of air circulation associated with the operation of the device 140. Optionally, an electrical switch 166 is in electrical communication with the printed circuit board 154, the switch 166 extending from the housing 142 to provide various operational modes illustratively including rotation of head 158 only, illumination of LED 156, on/off, or various patterns of LED illumination. An LED 156 is appreciated to be operable in various modes including continuous emission, periodic emission or various patterns of emission associated with multiple LEDs to provide visually interesting effects.

FIG. 9 depicts an alternate design of an illuminated rotating head amusement device relative to FIG. 8 where like numerals correspond to previously described components. The device 180 depicted in FIG. 9 varies from that depicted in FIG. 8 with regard to the nature of the rotating head 182. The head 182 has LEDs 156 decorating the head 182. A protective transparent globe 184 envelopes the rotating head 182 and is secured to the housing 142.

A typical operational scheme for an inventive rotating head device as depicted in either FIG. 8 or FIG. 9 is shown as a schematic in FIG. 10. With the rotating head 158 or 182 and the LEDs 156 in an off position, at step 200 the hand crank 146 is elevated through an arc of 180 degrees and cranked so as to charge a battery at step 202. After cranking for a sufficient time to impart charge to the battery 160, the switch 166 is moved to a position to create an electrical circuit between the battery 160 and the LED 156, head 158 or 182, or combination thereof at step 204. Rotation of the head and/or LED illumination thereafter occurs at step 206.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

The invention claimed is:

1. A dynamo powered amusement device comprising:

a housing;

a movement amusement actuator comprising a solenoid or an electric motor contained in said housing for inducing a movement of said housing or a portion of said housing relative to a remainder of said housing;

one or more amusement function components integrated into said housing of a light emitting diode, an auditory generator, or a video display;

an electrical power source for said one or more amusement functions and said movement amusement actuator, said power source comprising a user powered dynamo in said housing;

a user mechanical interface for energizing said dynamo; and a printed circuit in electrical communication with said power source and said one or more amusement function components and said movement amusement actuator, said printed circuit moderating power supply from said dynamo and operation of said one or more amusement components and said movement amusement actuator, said one or more amusement components and said movement amusement actuator receiving the power supply from said dynamo during operation of said dynamo.

2. The device of claim 1 wherein function of said one or more amusement components are provided sequentially.

3. The amusement device of claim 1 further comprising an electrical switch initiating said one or more amusement components.

4. The device of claim 1 wherein one of said one or more amusement components is the auditory generator.

5. The device of claim 4 wherein an output of the auditory generator is prerecorded.

6. The device of claim 5 further comprising a microphone for recording the output.

7. The device of claim 1 wherein said housing is configured in a form of: animal, human, fanciful creature, a cave, or a manmade structure.

8. The device of claim 1 wherein the movement amusement actuator creates the movement of the housing portion relative to the remaining portion of said housing.

9. The device of claim 8 wherein the housing portion hingeably moves relative to the remainder portion of said housing.

10. The device of claim 8 wherein said one or more amusement functions is only the light emitting diode illumination.

11. The device of claim 1 wherein said dynamo supplies said electrical power to said rechargeable battery.

12. A dynamo powered amusement device comprising:

a housing;

amusement function components creating a rotary movement and a light emitting diode illumination;

an electrical power source for said amusement function components comprising a user powered dynamo independent of a battery in said housing;

a user mechanical interface for energizing said dynamo; and a printed circuit board in electrical communication with said power source and said amusement function components moderating power supply from said power source and operation of said amusement function components, said amusement components receiving the power supply from said dynamo during operation of said dynamo; and wherein said amusement function components comprises an electric motor contained in said housing that create said rotary movement.

13. The device of claim 12 further comprising an electrical switch for initiating selectively one of the rotary movement or the light emitting diode illumination.

14. The device of claim 13 wherein said manual mechanical interface is a pull cord engaging a spring-tensioned spool in mechanical communication with said dynamo.

15. The device of claim 13 wherein said figurine is a plush.

16. The device of claim 12 wherein said electrical power source further comprises a capacitor energy storage energized by said dynamo.

17. A figurine comprising:

a figurine housing constructed to simulate a variety of animal, human, or fanciful creatures;

a power source consisting of a dynamo in said figurine housing;

a user mechanical interface for energizing said dynamo;

printed circuit board receiving an electrical input from said dynamo; and multiple amusement functions created by said printed circuit board powering at least one of an auditory generator, a light emitting diode, and a mechanical actuator, to create at least one of light emission, an electrically driven movable jointed appendage or prerecorded music or spoken utterances; and wherein said mechanical actuator comprises a solenoid or an electric motor contained in said housing that creates movement in said electrically driven movable jointed appendage.

18. A dynamo powered jack-in-the box amusement device comprising:

a jack-in-the box in a housing having an opening;

a housing lid hingeable covering the opening and attached to said box housing;

a first solenoid or first electric motor opening switch for releasing said housing lid;

a figurine within said box housing and extendable from the opening;

an electrically powered auditory generator;

a dynamo in said housing;

a movement actuator in said housing coupled to said figurine comprising a secondary solenoid or a second electric motor;

a user mechanical interface for energizing said dynamo to produce an electrical output; and a printed circuit board in electrical communication with said dynamo to power said first solenoid, said movement actuator, and said auditory generator;

wherein said movement actuator creates movement of said figurine; and wherein said first solenoid or said first electric motor, said movement actuator, and said auditory generator receives the power from said dynamo during operation of said dynamo.

19. The dynamo powered jack-in-the box of claim 18 wherein said auditory generator is a speaker, buzzer, piezoelectric vibratory crystal, a bell, music box, chime, or a bellows.

20. The dynamo powered jack-in-the box of claim 18 further comprising at least one of a figurine auditory generator, and light emitting diode decorating said figurine.

21. The dynamo powered jack-in-the-box of claim 18 further comprising a capacitor energy storage for storing the electrical output to power said solenoid and said auditory generator.

22. A dynamo powered music box comprising:

a music box in a housing having an opening;

a housing lid hingeable covering the opening and attached to said housing;

a first solenoid opening switch for releasing said housing lid;

a figurine within said housing and extendable from the opening;

an electrically powered auditory generator;

a dynamo in said housing;

a movement actuator in said housing coupled to said figurine comprising a secondary solenoid or an electrical motor;

a manual mechanical interface for energizing said dynamo to produce an electrical output; and a printed circuit board in electrical communication with said dynamo, said solenoid, said movement actuator, and said auditory generator;

wherein said movement actuator creates movement of said figurine; and wherein said first solenoid, said movement actuator, and said auditory generator receives the power from said dynamo during operation of said dynamo.

23. The music box of claim 22 wherein said auditory generator is a speaker, buzzer, piezoelectric vibratory crystal, a bell, chime, or a bellows.

24. The music box of claim 22 further comprising at least one of a figurine auditory generator, and a light emitting diode decorating said figurine.

25. A dynamo powered amusement device comprising:

a housing;

an auditory generator;

a movement actuator in said housing comprising a solenoid or an electric motor;

an electrical power source for said auditory generator comprising a user powered dynamo in said housing;

a user mechanical interface for energizing said dynamo; and a printed circuit board in electrical communication and said auditory generator and said movement actuator moderating power supply from said power source and operation of said auditory generator and said movement actuator, said auditory generator and said movement actuator receiving the power supply from a rechargeable battery charged by said dynamo during operation of said dynamo; and wherein said rechargeable battery supplies power when said user mechanical interface for energizing said dynamo is not being operated.

26. The device of claim 25 further comprising a microphone for recording the output.

27. The device of claim 25 wherein said housing is configured in a form of: animal, human, fanciful creature, a cave, or a manmade structure.

28. The device of claim 25 wherein said electrical power source further comprises a capacitor energy storage energized by said dynamo.

29. A dynamo powered amusement device comprising:

a housing;

a light emitting diode;

a movement actuator in said housing coupled comprising a solenoid or an electric motor;

an electrical power source for said light emitting diode comprising a user powered dynamo in said housing;

a user mechanical interface for energizing said dynamo; and a printed circuit board in electrical communication and said light emitting diode and said movement actuator moderating power supply from said power source and operation of said light emitting diode and said movement actuator, said light emitting diode and said movement actuator receiving the power supply from a rechargeable battery charged by said dynamo during operation of said dynamo; and wherein said rechargeable battery supplies power when said user mechanical interface for energizing said dynamo is not being operated.

30. The device of claim 29 wherein said housing is configured in a form of: animal, human, fanciful creature, a cave, or a manmade structure.

31. The device of claim 29 wherein said electrical power source further comprises a capacitor energy storage energized by said dynamo.

* * * * *